US009373494B1

(12) United States Patent
Vidal

(10) Patent No.: US 9,373,494 B1
(45) Date of Patent: Jun. 21, 2016

(54) SPARKER FOR FLASH LAMP

(71) Applicant: Excelitas Technologies Corp., Waltham, MA (US)

(72) Inventor: David Vidal, Amesbury, MA (US)

(73) Assignee: Excelitas Technologies Corp., Waltham, MA (US)

( * ) Notice: Subject to any disclaimer, the term of this patent is extended or adjusted under 35 U.S.C. 154(b) by 0 days.

(21) Appl. No.: 14/739,206

(22) Filed: Jun. 15, 2015

(51) Int. Cl.
*H01J 17/18* (2012.01)
*H01J 61/90* (2006.01)
*H01J 61/16* (2006.01)

(52) U.S. Cl.
CPC *H01J 61/90* (2013.01); *H01J 61/16* (2013.01)

(58) Field of Classification Search
CPC ..... G01V 1/157
USPC ..... 313/623, 318.06, 318.12
See application file for complete search history.

(56) References Cited

U.S. PATENT DOCUMENTS

2006/0152128 A1* 7/2006 Manning ..... H01J 61/025 313/113

OTHER PUBLICATIONS

Drawing of Proprietary Sparker Assembly, Drawing No. 69-0516, Excelitas Technologies Corp., dated Feb. 29, 2000.
Drawing of Proprietary Centerline Assembly, HFX1500/1800 Lamps, Drawing No. 1004614, Excelitas Technologies Corp., dated Sep. 12, 2013.

* cited by examiner

*Primary Examiner* — Vip Patel
(74) *Attorney, Agent, or Firm* — Peter A Nieves; Sheehan Phinney Bass & Green PA

(57) ABSTRACT

A base assembly for a flash lamp is disclosed. The base assembly has an integrated sparker and includes an electrically conductive header having a surface that defines a boundary of a flash chamber for the flash lamp. There is an opening in the surface of the electrically conductive header and an electrically conductive lead within the opening. The electrically conductive lead is electrically insulated from surrounding portions of the electrically conductive header. A distal end of the electrically conductive lead is substantially flush with the surface of the electrically conductive header.

28 Claims, 8 Drawing Sheets

SPARKER FOR FLASH LAMP

FIELD OF THE INVENTION

This disclosure relates to a sparker for a flash lamp and, more particularly relates to a sparker integrated into a hermetic feed-through assembly for the flash chamber in the flash lamp.

BACKGROUND

Flash lamps tend to be the light engine of choice for high performance flash and arc lamp applications such as medical and industrial spectroscopy, laser pumping, digital and studio photography, warning beacons and strobes, stroboscopic and effect lighting. Generally speaking, Xenon and Krypton flash lamps are confined arc flash lamps which typically produce microsecond to millisecond duration pulses of broadband light of high radiant intensities. Capable of operating at high repetition rates, these flash lamps typically can generate light over a continuous spectrum from ultraviolet to infrared.

Some flash lamp designs can be structurally complex and difficult and costly to manufacture. Improvements are needed.

SUMMARY OF THE INVENTION

In one aspect, a base assembly for a flash lamp is disclosed. The base assembly has an integrated sparker and includes an electrically conductive header having a surface that defines a boundary of a flash chamber for the flash lamp. There is an opening in the surface of the electrically conductive header and an electrically conductive lead within the opening. The electrically conductive lead is electrically insulated from surrounding portions of the electrically conductive header. A distal end of the electrically conductive lead is substantially flush with the surface of the electrically conductive header.

In a typical implementation, there is nothing electrically conductive physically attached to the distal end of the electrically conductive lead inside the flash chamber.

In another aspect, a flash lamp includes a base assembly and a cover coupled to the base assembly. The cover and the base assembly collectively define a flash chamber for the flash lamp. The base assembly includes an electrically conductive header having a surface that defines a boundary of the flash chamber. There is a plurality of openings in the electrically conductive header and an electrically conductive lead within each one of the openings. Each electrically conductive lead is electrically insulated from surrounding portions of the electrically conductive header. A distal end of a particular one of the electrically conductive leads is substantially flush with the surface of the electrically conductive header.

In a typical implementation, there is nothing electrically conductive physically attached to the distal end of the electrically conductive lead inside the flash chamber.

In some implementations, one or more of the following advantages are present.

For example, the structures disclosed herein provide a compact, low cost, simple design for a reliable flash lamp assembly, particularly with regard to the sparker for the flash lamp. In a typical implementation, the sparker lowers the work function of the electrodes in the flash lamp, thereby decreasing the likelihood and severity of flash-to-flash variation.

As described in detail herein, the sparker is integrated directly into a hermetic feed-through header in the flash lamp. This essentially eliminates current, more complex, sub-assembly designs and replaces them with a simple drop-in part formed during a feed-through sealing operation. This reduces labor, cost and operational variability associated with flash lamps and associated sparkers. Moreover, by placing the photon emitter (i.e., sparker) in, or substantially in, a flat ground plane away from the main lamp discharge, extraneous electric and pressure wave effects of the main discharge can be isolated.

Also, in some implementations, by placing the sparker in a flat ground plane, the electrical inductance that would have been inherent in the addition of a separate sparker sub assembly, welded to a hermetic feed-thru, is reduced. Any added electrical inductance is generally undesirable as it tends to cause timing delays and reduced energy in the sparker discharge.

The structures and techniques disclosed herein can help save labor cost and material cost. Moreover, they provide an opportunity for a competitive advantage based on improved reliability and performance over other flash lamp designs.

Other features and advantages will be apparent from the description and drawings, and from the claims.

BRIEF DESCRIPTION OF THE DRAWINGS

Like reference numerals represent like elements.

DETAILED DESCRIPTION

Figure 1A:
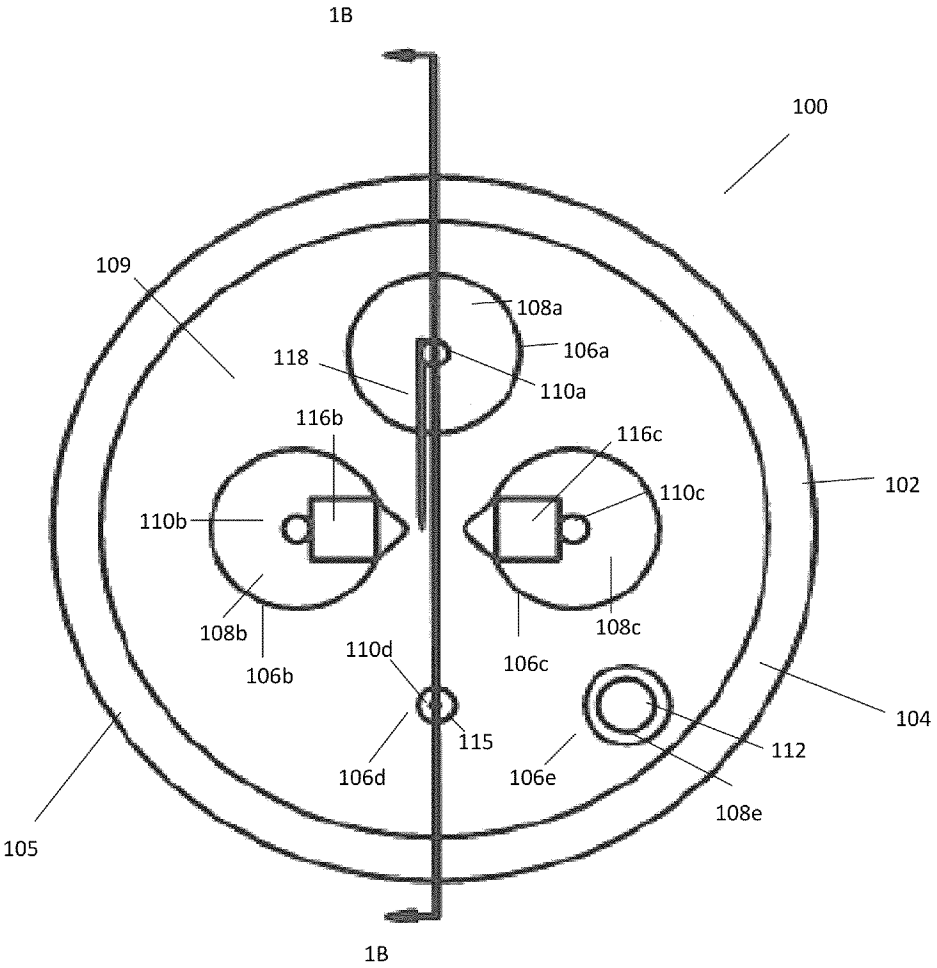
FIG. 1A is a schematic top view of an exemplary flash lamp with its cover removed.
Figure 1B:
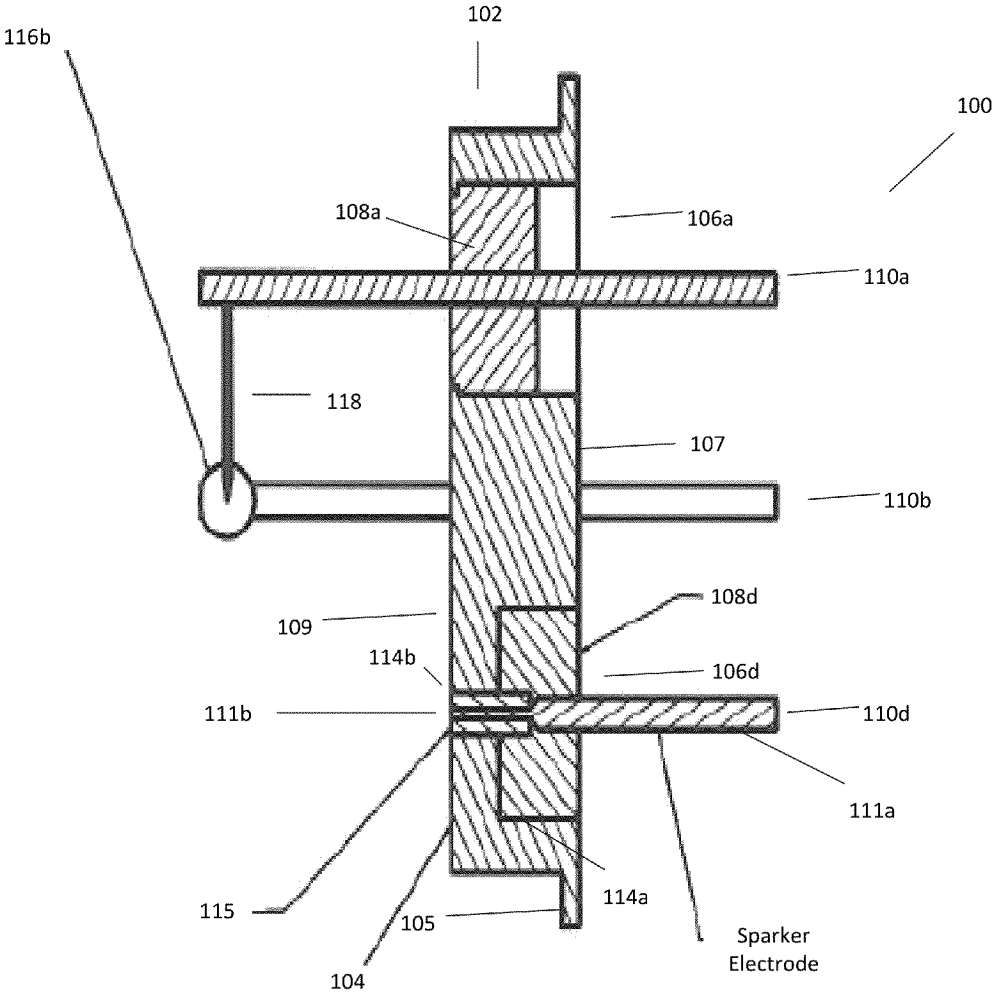
FIG. 1B is a cross-sectional side view of the exemplary flash lamp in FIG. 1A.

FIG. 1A is a top view of an exemplary flash lamp 100 with its cover removed. FIG. 1B is a cross-sectional side view of the flash lamp 100 taken along the line labeled 1B-1B in FIG. 1A. The flash lamp 100 represented in FIG. 1A and FIG. 1B is an electric arc lamp configured to produce extremely intense, incoherent, full-spectrum white light for very short durations. In a typical implementation, the flash lamp 100 in FIG. 1A and FIG. 1B has certain structural aspects that are beneficial in their own right and also lead to simpler flash lamp manufacturing processes.

The illustrated flash lamp 100 has a flash chamber, which is not specifically identified in FIG. 1A or 1B, but that would be an enclosed space defined by the base assembly 102 and a cover, which is not shown in FIG. 1A or 1B. In FIG. 1A, the flash chamber would be configured so that it extended out of the page and, in FIG. 1B, the flash chamber would be configured so that it extended to the left of the illustrated base assembly 102. In a typical implementation, the flash chamber is a hermetically-sealed compartment that accommodates the flash produced by flash lamp 100. Moreover, in a typical implementation, the cover, that partially defines the flash chamber would include a window that allows light from the flash to exit the flash chamber.

In the illustrated implementation, the base assembly 102 has a header 104 and a number of components that are supported either directly or indirectly by the header 104. The header 104 can be virtually any kind of material. In a typical implementation, the header 104 is or includes an electrically conductive material. In one particular exemplary implementation, the header is made of a Kovar™ material sold, for example, by CRS Holdings, Inc. of Delaware in the United States. Numerous other materials are possible as well.

The header 104 is substantially disk-shaped with a flange 105 that extends in a radially outward direction at one end. The flange 105 can be used to help secure the cover to the header 104 and/or can help secure the overall flash lamp 100 to some other external mounting surface (not shown in FIGS. 1A and 1B). A wide variety of fasteners including, for example, adhesive material, solder, fastening devices, such as screws or the like, etc. can be used to secure the cover to the header and to secure the overall flash lamp 100 to an external mounting surface.

The header 104 in the illustrated implementation defines five openings 106*a*-106*e*, each of which extends in a substantially longitudinal direction through the header 104 from a first surface 107 of the header 104 outside the flash chamber to a second surface 109 of the header 104 inside the flash chamber.

One of the openings 106*e*, which is near an outer edge of the header 104 away from the others, is really only used during the flash lamp manufacturing process (e.g., to inject xenon or other gas into the flash chamber), after which it is sealed or pinched off. In this regard, a tube 112 extends through opening 106*e* in the header 104. This tube 112 is typically used to introduce the gas (e.g., Xenon and/or other gases) into the flash chamber during manufacturing of the flash lamp 100. The tube 112 is generally sealed off after the gas is introduced and the tube 112 does not otherwise play a role in the flash tube's operations. Generally speaking, Xenon can be used to facilitate excitation in certain types of flash lamps. In an exemplary implementation, that opening 106*e* and tube 112 would have has a substantially cylindrical diameter with a relatively constant diameter throughout, at least until it is sealed or pinched off after the gas (e.g., xenon) is injected into the flash chamber. This opening 106*e* and tube 112 will not be discussed in detail any further, except where mentioned in connection with the manufacturing process described below.

Four of the openings 106*a*-106*d* are arranged so as to surround the axial centerline of the header 104. Moreover, each opening (e.g., opening 106*a*) is arranged so that its axial centerline is approximately equidistant from the axial centerline of the header 104 as the axial centerlines of the other openings (e.g., 106*b*-106*d*). These four openings are displaced from one another at angular intervals around the axial centerline of the header at approximately 90 degrees intervals.

Three of the openings 106*a*-106*c* have substantially cylindrical walls that extend with substantial uniformity from the outer surface 107 of the header 104 to the inner surface 109 of the header 104. In some implementations, there is a very slight reduction in diameter near the inner surface 109 of the header 104, but otherwise these would have substantially constant diameters. The fourth of these openings 106*d* has a wall with a stepped configuration that defines an outer portion 114*a* with a substantially cylindrical wall having a first (larger) diameter and an inner portion 114*b* with a substantially cylindrical wall having a second (smaller) diameter. In the illustrated implementation, the diameters of the openings 106*a*-106*c* and the outer portion of opening 106*d* are substantially identical.

Each of the four openings 106*a*-106*d* in the header 104 is filled with a sealing material that forms a seal 108*a*-108*d* that surrounds and physically supports, a corresponding one of four electrically-conductive leads 110*a*-110*d* that extends through the sealing material passing from outside the flash chamber to the flash chamber.

The seals 108*a*-108*d* can be made from any one of a variety of different sealing materials. In a typical implementation, however, each seal 108*a*-108*d* is made from or includes an electrically insulating material, such as glass or the like. Moreover, each electrically-conductive lead 110*a*-110*d* extends through an approximate center of its corresponding seal so that the sealing material electrically insulates each electrically-conductive lead from surrounding portions of the header 104, which, again, is typically electrically conductive.

Each seal 108*a*-108*d* can have a variety of possible configurations. However, in the illustrated implementation, each seal 108*a*-108*d* is substantially annular. Moreover, three of the seals 108*a*-108*c* are configured so as to be substantially flush with the inner surface 109 of the header 104, but recessed a bit relative to the outer surface 107 of the header 104. In these seals 108*a*-108*c* the sealing material only partially fills the corresponding opening 106*a*-106*c* where it is located.

The fourth feed-through seal 108*d* is configured so as to be substantially flush with an outer surface of the base assembly 102. This feed-through seal 108*d* fills the outer (wider) portion 114*a* of opening 106*d* substantially completely, but does not extend into the inner (narrower) portion 114*b* of the opening 106*d* at all.

Each electrically conductive lead 110*a*-110*d* contributes to creating and/or controlling the flash. In this regard, each electrically conductive lead 110*a*-110*d* has a first end located outside the flash chamber that can be connected to a corresponding circuit component and a second end exposed to the flash chamber. Three of the electrically-conductive leads 110*a*-110*c* have substantially constant diameters from end to end.

The other electrically-conductive lead 110*d*, which facilitates sparker electrode functionality for the flash lamp, has a stepped configuration, with a first portion 111*a* (outside the flash chamber) having a first (larger) diameter, a second portion 111*b* having a second (smaller) diameter and a taper between the first, larger diameter portion 111*a* and the second, smaller diameter portion 111*b*.

The second (smaller diameter) portion 111*b* of electrically-conductive lead 110*d* in the illustrated implementation has an electrically-insulating sleeve 115 that electrically insulates the second (smaller diameter) portion 111*b* of the electrically-conductive lead 110*d* from surrounding portions of the header 104. In this regard, the second (smaller diameter) portion 111*b* of electrically-conductive lead 110*d* and the electrically-insulating sleeve 115 extend from approximately flush with the inner surface of the header 104 back to and into the portion of the opening that is filled with sealing material 108*d*. The electrically-insulating sleeve 115 can be made from any one of a variety of different materials, such as, for example, a ceramic material.

Three of the electrically conductive leads 110*a*-110*c* extend well beyond the inner edge of the base assembly 102 into the flash chamber. The actual distance that these three electrically conductive leads 110*a*-110*c* extend into the flash chamber can vary. However, generally, and as shown, all three extend approximately equidistant into the flash chamber.

As mentioned above, electrically conductive lead 110*d* and its insulating sleeve 115 are configured such that their distal ends are substantially flush with the inner surface 109 of the header assembly 104. Substantially flush in this regard should be interpreted to mean nearly or precisely flush. The distal end of the electrically conductive lead 110*d* and the distal end of insulating sleeve 115 may be considered nearly flush with the inner surface 109 even if they extend beyond the inner surface 109 of the header 104 by a small amount (e.g., up to about 0.5 mm). Moreover, the distal end of the electrically conductive lead 110*d* and the distal end of insulating sleeve 115 may be considered nearly flush with the inner surface 109 even if they are recessed relative to inner surface 109 by a small amount. (e.g., up to about 0.5 mm).

In a typical implementation, the distal end of the electrically conductive lead 110*d* and the distal end of insulating sleeve 115 are substantially flush with each other. However, that is not a requirement. Indeed, in some implementations, the distal end of the electrically conductive lead 110*d* and the distal end of insulating sleeve 115 are offset relative to one another as much as 0.5 mm.

As shown in FIG. 1A and FIG. 1B, the distal end of electrically conductive lead 110*d* is substantially flush with the inner edge of the header 104 and is exposed to the flash chamber. Moreover, in a typical implementation, and as shown in FIGS. 1A and 1B, there is nothing physically attached to the distal end of the electrically conductive lead 110*d* inside the flash chamber—certainly nothing that is electrically conductive. The electrically insulating sleeve 115 electrically insulates the distal portion of the electrically conductive lead 110*d* from surrounding portions of the header 104 (which is itself electrically conductive), but leaves the distal end of the electrically conductive lead 110*d* uncovered and exposed to the flash chamber.

According to the illustrated implementation, the smaller diameter portion 114*b* of the fourth opening 106*d* is sized to snugly accommodate the smaller diameter portion 111*b* of the electrically conductive lead 110*d* and the electrically insulating sleeve 115 that surrounds the smaller diameter portion 111*b* of the electrically conductive lead 110*d*. The electrically insulating sleeve 115 has a substantially uniform thickness around its entire perimeter and length. This thickness primarily establishes the distance between the exposed distal end of electrically conductive lead 110*d* inside the flash chamber and surrounding portions of the electrically conductive header 104. Generally speaking, this distance should be short enough so that electrical arcing can occur across the distance under appropriate operational circumstances, but long enough to avoid undesirable occurrences of electrical arcing across that distance. In a typical implementation, the distance is between 0.2 mm and 0.5 mm.

Operationally, two of the electrically conductive leads 110*b*, 110*c* act as electrode leads for the flash lamp 100. As such, each of these electrically conductive leads 110*b*, 110*c* has at (or near) its distal end inside the flash chamber, an arc-lamp (or flash lamp) electrode 116*b*, 116*c*. The physical arrangement of the electrically conductive lead 110*b* and its arc-lamp electrode 116*b* is substantially a mirror image of the physical arrangement of the electrically conductive lead 110*c* and its arc-lamp electrode 116*c* in the illustrated implementation. In a typical implementation, one of the arc-lamp electrodes (e.g., 116*b*) would be connected to receive a positive voltage, whereas the other one of the arc-lamp electrodes (e.g., 116*c*) would be connected to receive a negative voltage, such that an electrical arc can occur in the space between the arc-lamp electrodes 116*b*, 116*c* as a result of the electrical voltage difference applied across the arc-lamp electrodes 116*b*, 116*c*.

There is a probe (wire) 118 connected at (or near) a distal end of another one of the other electrically conductive leads 110*a* inside the flash chamber. This probe 118 extends from the electrically conductive lead 110*a* into or near the space between the arc-lamp electrodes 116*b*, 116*c*. In general, and as shown in the illustrated implementation, a distal end of the probe 118 is approximately midway (or close to midway) between the arc-lamp electrodes 116*b*, 116*c*. Generally speaking, during operation of the flash lamp 100, a voltage can be applied to the probe 118 via its electrically conductive lead 110*a* to influence the arc that extends across the arc-lamp electrodes 116*b*, 116*c*. The probe 118, in the illustrated implementation, extends from its electrically conductive lead 110*a* in a substantially orthogonal direction toward the space between the arc-lamp electrodes 116*b*, 116*c*.

As mentioned above, the distal end of electrically conductive lead 110*d* is substantially flush with the inner surface of the header 104 and is exposed to the flash chamber. The end of the electrical insulating sleeve 115 is also substantially flush with the inner surface of the base assembly 102 and electrically insulates the distal end of the electrically conductive lead 110*d* from surrounding portions of the header 104. Moreover, the distal end of the electrically conductive lead 110*d* and the end of the electrical insulating sleeve 115 are exposed to the flash chamber through an inner end of the smaller diameter portion 114*b* of the fourth opening 106*d* through the base assembly 102.

In a typical implementation, operationally, the exposed portions of the electrically conductive lead 110*d*, the insulating sleeve 115 and the surrounding, nearby portions of the electrically conductive header 104 act as a sparker electrode (e.g., an integrated resonator photon emitter) to help regulate and improve various operational aspects of the flash lamp 100. For example, in some implementations, this photon emitter arrangement can advantageously help control and/or improve stability in flash-to-flash output levels and timing between subsequent flashes. To do this, in a typical implementation, during flash lamp operation, the sparker electrode may be connected so that when a trigger voltage is applied to it, the sparker electrode begins to discharge thereby producing ultraviolet (UV) light. The UV light causes the electrodes 116*b*, 116*c* to emit photoelectrons, which then ionize the xenon gas inside the flash chamber. This tends to stabilize the arc discharge between electrodes 116*b*, 116*c*.

Each of the electrically conductive leads 110*a*-110*d* has a portion that extends outside the flash chamber for attaching to a corresponding electrical connection (e.g., a voltage source or ground connection) that is appropriate for its operational role.

Figure 2:
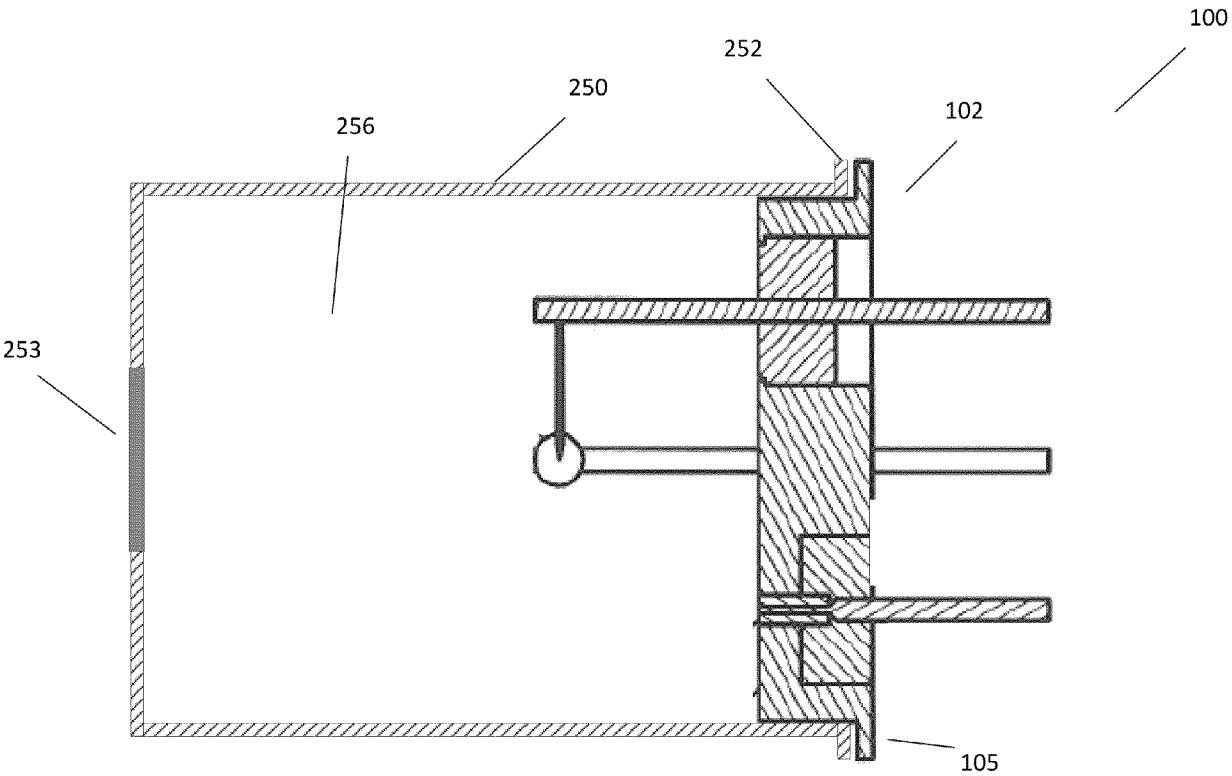
FIG. 2 is a schematic, cross-sectional side view of the exemplary flash lamp in FIG. 1A with its cover in place.

FIG. 2 shows the flash lamp 100 with its cover 250 in place. The illustrated cover 250 has an outwardly-extending flange 252 that extends around the perimeter of its open end. The flange 252 on the cover 250 in the illustrated implementation is securely coupled to the corresponding flange 105 on the base assembly 102. This coupling can be achieved using any one of a number of possible securing means including, for example, an adhesive material or a welded or soldered connection.

The base assembly 102 and cover 250 in the illustrated implementation cooperatively define the flash chamber 256. The cover 250 in the illustrated implementation has a window 253 that is made of a material (e.g., glass or the like) through which the flash can exit the flash chamber 256. In some implementations, the rest of the cover 250 is substantially opaque to the flash produced inside the flash chamber 256.

Figure 3:
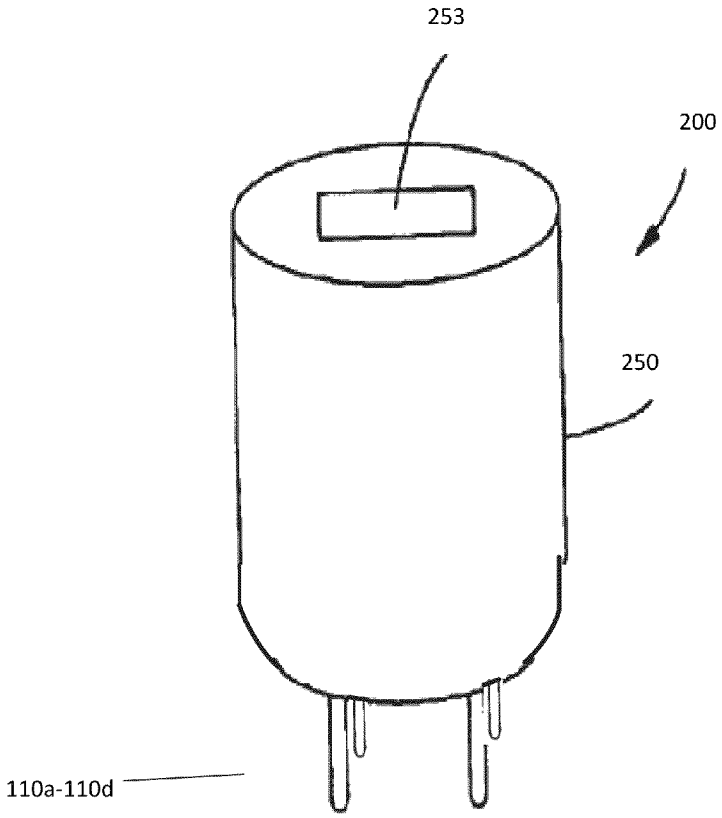
FIG. 3 is a perspective view of the exemplary flash lamp in FIG. 2.

FIG. 3 shows a perspective view of the exemplary flash lamp 100 in FIG. 2. FIG. 3 clearly shows the cover 250, with the window 253 in an upper surface of the cover 250. Parts of the electrically conductive leads 110*a*-110*d* can be seen extending out from the bottom of the flash lamp 200 in a downward direction.

The flash lamp 100 disclosed herein provides a relatively simple, cost effective design that is simple to manufacture.

Figure 4:
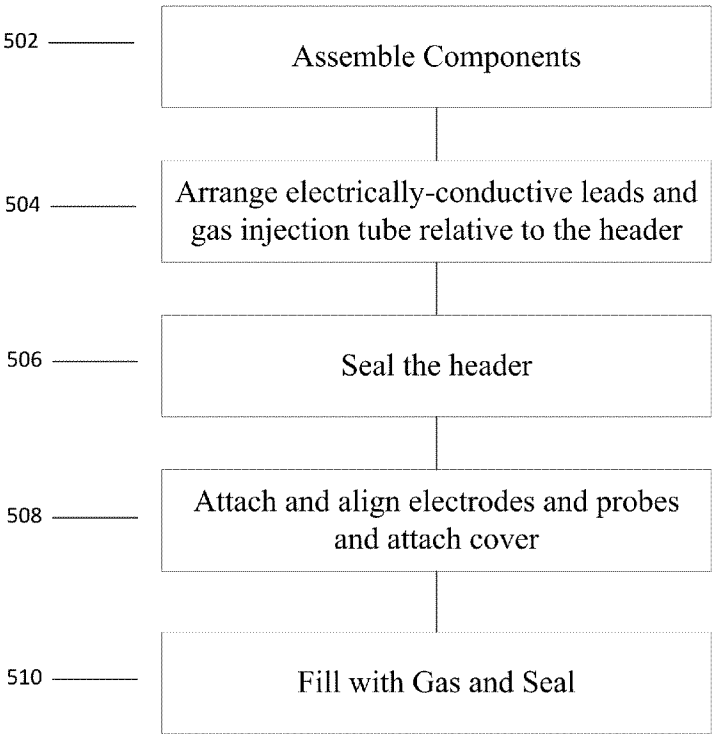
FIG. 4 is a flowchart of an exemplary manufacturing process for the flash lamp in FIG. 3.

In this regard, FIG. 4 shows a series of steps involved in an exemplary process for manufacturing the flash lamp 100 disclosed herein.

In particular, the exemplary process includes, at 502, assembling the flash lamp components. Typically, this would include assembling at least the header 104 (with multiple openings 106*a*-106*e*), the electrodes 110*a*-110*d* (one 110*d* of which having an electrically insulating sleeve 115 around one end of it), electrodes 116*b*, 116*c* (for the ends of two of the electrodes 110*b*, 110*c*), the probe 118 (for the end of another of the electrodes 110*a*), the tube 112, and the cover 250.

Next, the process includes, at 504, arranging the electrically-conductive leads 110*a*-110*d* and the gas injection tube 102 relative to the header 104 approximately as they should end up in the final flash lamp assembly. Typically, this is accomplished using a fixture that holds the electrodes 110*a*-110*d* and the tube 112, with each passing through a corresponding one of the openings in the header, according to a desired configuration relative to the header 104.

At 506, the process includes sealing the header 104. This is usually accomplished by placing glass preforms (or other sealing material) into each of the openings in the header 104 around a component (e.g., electrode 110*a*-110*d* or tube 112) that passes through that opening in the header 104. The glass is melted in a temperature and atmosphere controlled oven and allowed to cool and thereby harden to secure the components that pass through the header 104 in place relative to the header 104.

Next, at 508, the process includes attaching the electrodes 116*b*, 116*c* to the distal portions of the electrically-conductive leads 110*b*, 110*c* and attaching the probe 118 to the distal portion of the electrically-conductive lead 110*a*. Typically, the electrodes 116*b*, 116*c* and the probe 118 are welded onto their corresponding electrically-conductive leads. The electrodes 116*b*, 116*c* and the probe 118 are aligned, also at 508, to a desired configuration, such as the one shown in FIGS. 1A and 1B.

In a typical implementation, the resulting assembly at this point is a base assembly 102 similar to the one shown, for example, in FIGS. 1 and 2.

Also at 508, the cover 250, which includes a covered opening 253, is attached to the base assembly 102. In this regard, a flange 252 on the cover 250 typically is welded onto a corresponding flange 105 of the base assembly 102.

At this point, the base assembly 102 and the secured cover 250 define a flash chamber that is sealed except for the hollow tube 112 that passes through the base assembly 102.

Next, at 510, the flash chamber is filled with gas and sealed. In a typical implementation, thus entails using the tube 112 to evacuate the flash chamber, filling the flash chamber with Xenon and then closing off the tube 112 to hermetically seal the flash chamber now containing Xenon gas.

Figure 5B:
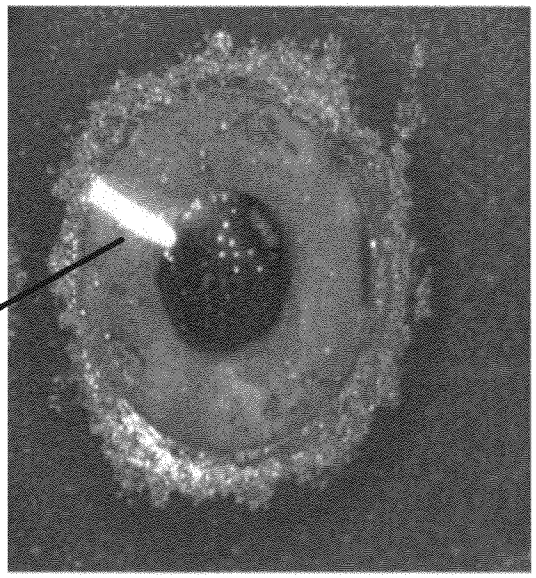
FIG. 5A and FIG. 5B are photographs showing arcing occurring across an insulating ring.
Figure 5A:
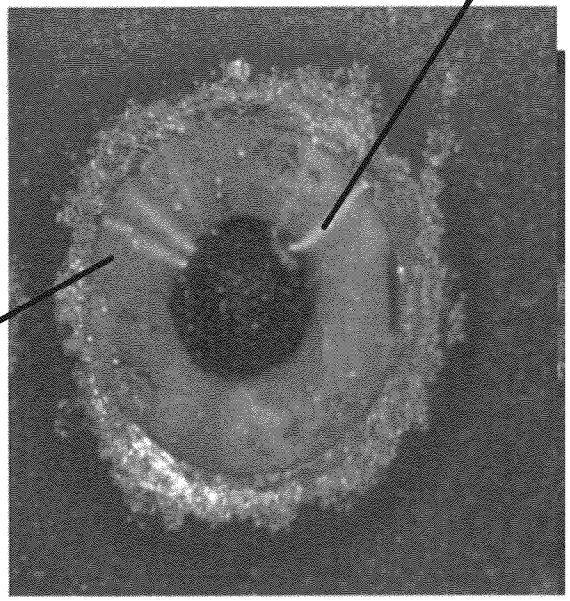

FIG. 5A and FIG. 5B are photographs showing arcing 668 occurring between the tip of a centrally disposed electrode, across an electrically insulating sleeve that surrounds the electrode, and an electrically conductive surface outside the electrically insulating sleeve. The tip of the centrally disposed electrode, the visible end of the electrically insulating sleeve and the visible portion of the electrically conductive surface in the illustrated implementations all lie with approximately the same plane.

FIG. 5A and FIG. 5B help show that effective arcing can be achieved with a design like the one disclosed herein—e.g., in FIGS. 1A and 1B.

Figure 6:
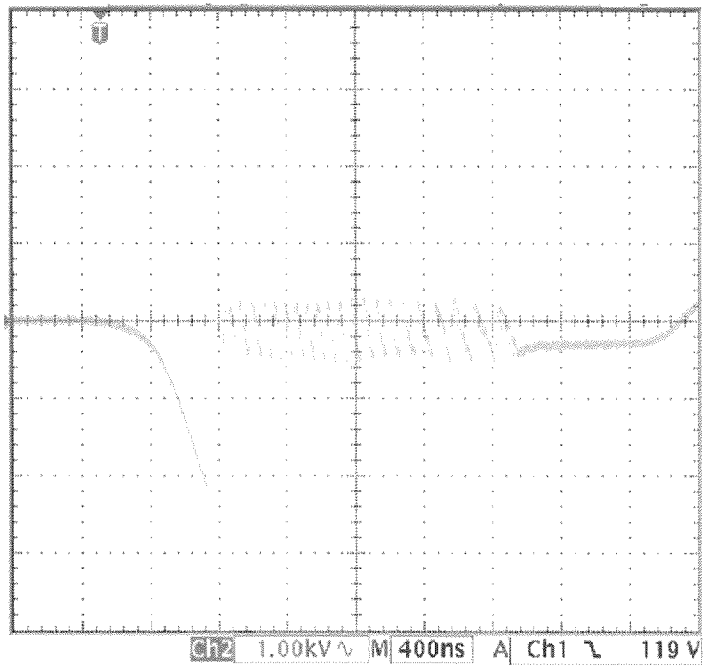
FIG. 6 is a plot of voltage vs. time for a sparker assembly similar to those disclosed herein.

FIG. 6 is a graph showing voltage applied to a sparker electrode, like 110*d* in FIG. 1A and FIG. 1B, over time. The graph shows ringing occurs at a relatively high frequency during the sparker discharge which provides high energy photons needed to lower the work function of the main discharge electrodes 116*b* and 116*c*.

Figure 7B:
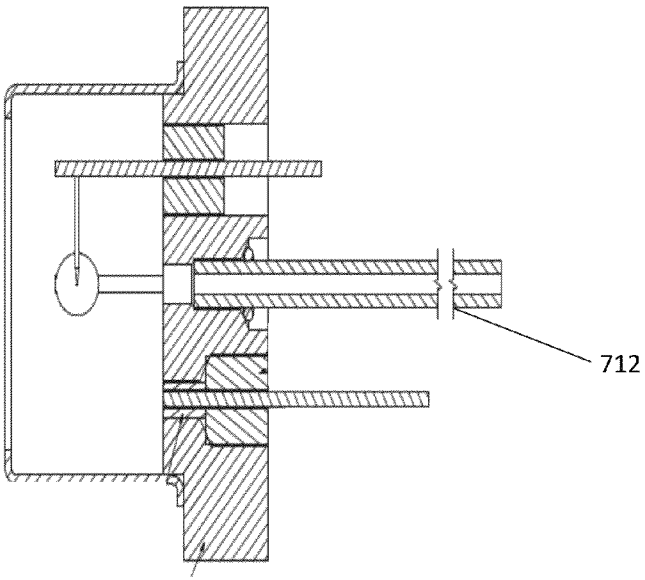
FIG. 7B is a cross-sectional side view of the exemplary flash lamp in FIG. 7A with its cover in place.
Figure 7A:
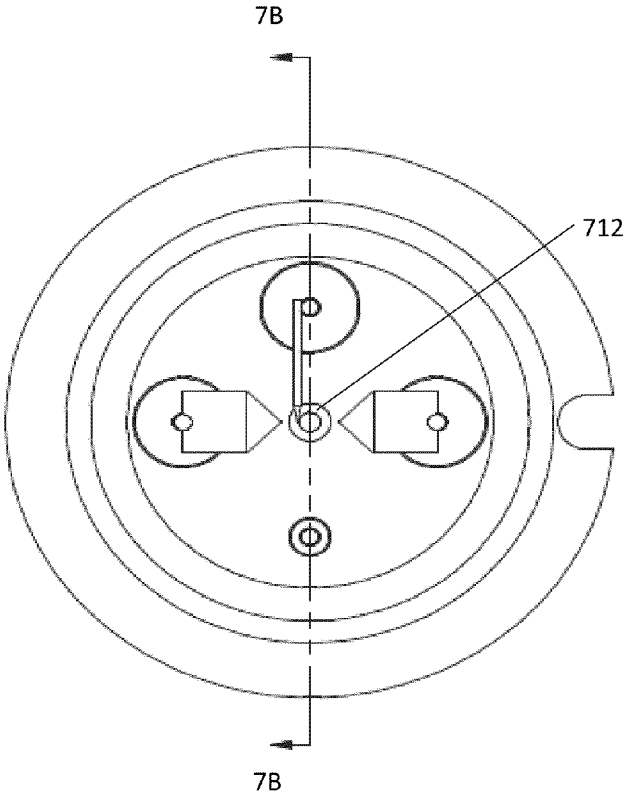
FIG. 7A is a schematic top view of another exemplary flash lamp with its cover removed.

FIG. 7A and FIG. 7B show an alternative design for a flash lamp. The design in FIG. 7A and FIG. 7B is similar to the design in FIG. 1A and FIG. 1B. The most notable difference between the FIG. 7A and FIG. 7B design and the design shown in FIG. 1A and FIG. 1B is that the design in FIG. 7A and FIG. 7B has a centrally disposed gas injection tube 712, and the sparker electrode 110*d* is of a constant diameter through its length.

A number of embodiments of the invention have been described. Nevertheless, it will be understood that various modifications may be made without departing from the spirit and scope of the invention.

For example, except where otherwise noted, the number of separate components, and the specific relative arrangement and size of each components disclosed herein can vary. For example, in some implementations two or more of the electrically conductive leads may be arranged to pass through one single opening in the electrically conductive header. In that instance, one contiguous application of sealing material would seal both of the electrically conductive leads in the opening.

Moreover, in certain implementations, one or more of the components disclosed herein may be changed or omitted entirely. For example, in some implementations, the separate insulating sleeve may be replaced with the sealing material that fills the back portion of the sparker electrically conductive lead opening. Alternatively, in some implementations, the insulating sleeve that surrounds the distal end of the sparker electrically-conductive lead may be omitted entirely, leaving only empty space to insulate the sparker electrically conductive lead from the surrounding portions electrically conductive header.

As another example, in some implementations, there may be no stepped configuration in the opening through which the sparker electrically conductive lead extends. Moreover, in some implementations, there may be no stepped configuration in the sparker electrically conductive lead itself.

Other components, not specifically described herein, may be added to the assemblies described herein.

The structures and processes disclosed herein are applicable to various different types of flash lamps including, for example, pulsed xenon flash lamps.

The processes can be varied herein, with different steps being performed in a different order than described herein. Some of the steps may be performed in parallel. Indeed, in some implementations, some of the steps may be omitted entirely.

A wide variety of materials and techniques are suitable for use in manufacturing and attaching the various components disclosed here.

It should be understood that relative terminology used herein, such as "near", "upper", "lower", "above", "below", "front", "rear," etc. is solely for the purposes of clarity and is not intended to limit the scope of what is described here to require particular positions and/or orientations or relative positioning. Accordingly, such relative terminology should not be construed to limit the scope of the present application. Generally speaking, when something is described as being near something else, that something should be understood as being at or a short distance away from, or nearby, that something else. So, for example, when the electrodes are described as being at or near a distal end of an electrically conductive lead, the electrode could be anywhere along the last, say 25%, or 15%, or 10% of the length of the electrically conductive lead close to the distal end.

Additionally, the term substantially, and similar words, such as substantial, are used herein. Unless otherwise indicated, substantially, and similar words, should be construed broadly to mean completely and almost completely (e.g., for a measurable quantity this might mean 99% or more, 95% or more, 90% or more, 85% or more). For non-measurable quantities (e.g., a surface that is substantially parallel to another surface), substantial should be understood to mean completely or almost completely (e.g., deviating from parallel no more than a few degrees (e.g., less than 3, 4 or 5 degrees).

Other implementations are within the scope of the claims.

What is claimed is:

1. A base assembly for a flash lamp, the base assembly comprising:

an electrically conductive header having a surface that defines a boundary of a flash chamber for the flash lamp;

an opening in the surface of the electrically conductive header; and an electrically conductive lead within the opening, wherein the electrically conductive lead is electrically insulated from surrounding portions of the electrically conductive header, and wherein a distal end of the electrically conductive lead is substantially flush with the surface of the electrically conductive header.

2. The base assembly of claim 1, further comprising:

an electrically insulating sleeve inside the opening and configured to electrically insulate the electrically conductive lead from the surrounding portions of the electrically conductive header.

3. The base assembly of claim 2, wherein a distal end of the electrically insulating sleeve is substantially flush with the surface of the electrically conductive header.

4. The base assembly of claim 2, wherein the surrounding portions of the electrically conductive header are close enough to electrically conductive lead that electrical arcing can occur between the electrically conductive lead and the surrounding portions of the electrically conductive header during flash lamp operation, but far enough away to avoid undesirable electrical arcing between the electrically conductive lead and the surrounding portions of the electrically conductive header during flash lamp operation.

5. The base assembly of claim 4, wherein the surrounding portions of the electrically conductive header are between 0.1 millimeters and 1.0 millimeters from the electrically conductive lead.

6. The base assembly of claim 1, wherein a distal end of the electrically conductive lead is exposed to the flash chamber.

7. The base assembly of claim 6, wherein no electrically conductive components are physically attached to the distal end of the electrically conductive lead.

8. The base assembly of claim 1, wherein the opening in the surface of the electrically conductive header extends through an entirety of the electrically conductive header, and wherein the opening has a stepped configuration with an outer portion that has a substantially cylindrical wall having a first diameter and an inner portion with a substantially cylindrical wall having a second diameter, and wherein the first diameter is larger than the second diameter.

9. The base assembly of claim 8, further comprising:

a sealing material in the larger outer portion of the opening, wherein the sealing material surrounds and physically supports the electrically-conductive lead.

10. The base assembly of claim 9, wherein a portion of the electrically conductive lead that extends beyond the sealing material external to the flash chamber is configured for connecting to an electrical circuit external to the flash lamp.

11. The base assembly of claim 1 configured such that, during operation of the flash lamp, when a trigger voltage is applied to the electrically conductive lead, the electrically conductive lead discharges to produce an ultraviolet (UV) light that causes electrodes in the flash lamp to emit photoelectrons, which ionize a xenon gas inside the flash chamber.

12. A flash lamp comprising:

a base assembly; and a cover coupled to the base assembly, wherein the cover and the base assembly collectively define a flash chamber for the flash lamp, wherein the base assembly comprises:

an electrically conductive header having a surface that defines a boundary of the flash chamber;

a plurality of openings in the electrically conductive header, an electrically conductive lead within each one of the openings, wherein each one of the electrically conductive leads is electrically insulated from surrounding portions of the electrically conductive header, and wherein a distal end of a particular one of the electrically conductive leads is substantially flush with the surface of the electrically conductive header.

13. The flash lamp of claim 12, wherein the particular one of the electrically conductive leads is configured to operate as a sparker for the flash lamp.

14. The flash lamp of claim 12, wherein the base assembly further comprises:

an electrically insulating sleeve inside a particular one of the openings and configured to electrically insulate the particular one of the electrically conductive leads from corresponding surrounding portions of the electrically conductive header.

15. The flash lamp of claim 14, wherein the corresponding surrounding portions of the electrically conductive header are close enough to particular one of the electrically conductive leads that electrical arcing can occur between the particular one of the electrically conductive leads and the corresponding surrounding portions of the electrically conductive header during flash lamp operation, but far enough away to avoid undesirable electrical arcing between the particular one of the electrically conductive leads and the corresponding surrounding portions of the electrically conductive header during flash lamp operation.

16. The flash lamp of claim 14, wherein the surrounding portions of the electrically conductive header are between 0.1 millimeters and 1.0 millimeters from the particular one of the electrically conductive leads.

17. The flash lamp of claim 15, wherein the electrically conductive leads other than the particular one of the electrically conductive lead are sufficiently insulated from the surrounding portions of the electrically conductive header to prevent electrical arcing during flash lamp operations.

18. The flash lamp of claim 14, wherein the surrounding portions of the electrically conductive header are between 1.0 millimeters and 3.0 millimeters from each of the electrically conductive leads other than the particular one of the electrically conductive lead.

19. The flash lamp of claim 14, wherein a distal end of the particular one of the electrically conductive leads is exposed to the flash chamber.

20. The flash lamp of claim 19, wherein no electrically conductive components are physically attached to the distal end of the particular one of the electrically conductive leads.

21. The flash lamp of claim 20, wherein the base assembly further comprises:

an electrode at or near a distal end of each of two of the electrically conductive leads inside the flash chamber.

22. The flash lamp of claim 20, wherein the base assembly further comprises:

a probe at or near a distal end of another one of the other electrically conductive leads inside the flash chamber, wherein the probe extends from the associated one of the electrically conductive leads into or near a space between the electrodes.

23. The flash lamp of claim 12, wherein each of the openings in the surface of the electrically conductive header extends through an entirety of the electrically conductive header, wherein a particular one of the openings has a stepped configuration with an outer portion that has a substantially cylindrical wall having a first diameter and an inner portion with a substantially cylindrical wall having a second diameter, and wherein the first diameter is larger than the second diameter.

24. The flash lamp of claim 23, further comprising:

a sealing material in the larger outer portion of the particular one of the openings, wherein the sealing material surrounds and physically supports a corresponding one of the electrically conductive leads.

25. The flash lamp of claim 23, further comprising a sealing material in each of the openings, wherein the sealing material surrounds and physically supports a corresponding one of the electrically conductive leads in each respective one of the openings.

26. The flash lamp of claim 25, wherein a portion of each one of the electrically conductive leads extends beyond the sealing material external to the flash chamber for connection to an electrical circuit external to the flash lamp.

27. The flash lamp of claim 12, wherein the base assembly is configured such that, during operation of the flash lamp, when a trigger voltage is applied to the particular one of the electrically conductive leads, the particular one of the electrically conductive leads discharges to produce an ultraviolet (UV) light that causes electrodes in the flash lamp to emit photoelectrons, which ionize a xenon gas inside the flash chamber.

28. The flash lamp of claim 12, wherein one and only one of the electrically conductive leads is in each respective one of the openings.

* * * * *